US006741161B1

(12) United States Patent
Kim et al.

(10) Patent No.: US 6,741,161 B1
(45) Date of Patent: May 25, 2004

(54) SYSTEM AND METHOD FOR PROVIDING USEFUL INFORMATION FOR A MOVING OBJECT

(75) Inventors: Shin Bae Kim, Seoul (KR); Gun Dong Min, Incheon (KR); Yun Sup Song, Seoul (KR); Jung Kook Ki, Seoul (KR); Young Kwan Kim, Seoul (KR); Ji Won Bang, Seoul (KR)

(73) Assignee: SK Telecom Co., Ltd., Seoul (KR)

( * ) Notice: Subject to any disclaimer, the term of this patent is extended or adjusted under 35 U.S.C. 154(b) by 0 days.

(21) Appl. No.: 09/202,043

(22) PCT Filed: Mar. 29, 1997

(86) PCT No.: PCT/KR97/00052

§ 371 (c)(1),
(2), (4) Date: Aug. 30, 1999

(87) PCT Pub. No.: WO97/47095

PCT Pub. Date: Dec. 11, 1997

(30) Foreign Application Priority Data

Jun. 7, 1996 (KR) ..... 96-20383
Mar. 25, 1997 (KR) ..... 97-10233

(51) Int. Cl.[7] ..... G08B 5/22

(52) U.S. Cl. ..... 340/7.1; 340/994; 340/7.48; 701/213

(58) Field of Search ..... 340/7.1, 7.2, 994, 340/7.48, 825.39, 991, 998, 995, 989, 904, 905, 7.52, 7.54, 7.56; 342/457, 458; 324/260, 226, 207.26; 434/307 R; 455/412, 70, 456, 517, 500; 701/200, 208, 213, 300

(56) References Cited

U.S. PATENT DOCUMENTS 4,812,843 A 3/1989 Champion, III et al.
5,214,793 A * 5/1993 Conway et al. ..... 455/500
5,218,629 A * 6/1993 Dumond et al. ..... 455/412
5,664,948 A * 9/1997 Dimitriadis et al. .... 434/307 R
5,736,940 A * 4/1998 Burgener ..... 340/994
5,808,565 A * 9/1998 Matta et al. ..... 340/994

FOREIGN PATENT DOCUMENTS

| | | |
|---|---|---|
| JP | 57-045800 | 3/1982 |
| JP | 64-38040 | 3/1989 |
| JP | 01-212377 | 8/1989 |
| JP | 6-318 899 | 11/1994 |
| JP | 6-326 648 | 11/1994 |
| JP | 08-030222 | 2/1996 |
| WO | WO 96/11436 | 4/1996 |

* cited by examiner

*Primary Examiner*—Michael Horabik
*Assistant Examiner*—William Bangachon
(74) *Attorney, Agent, or Firm*—Lowe Hauptman Gilman & Berner LLP

(57) ABSTRACT

A system for providing character-based information for a moving object include a GPS receiver receiving position information of the moving object, a character radio pager for receiving control information and character information, a living information database for storing the character-based information received from the character radio pager, a moving picture database for storing the control signals and operator information, a position information database for storing the position information from the movement of the moving object and providing announcement for the present moving position of the moving object, a CPU for extracting useful information from the GPS receiver and the character radio pager or extracting an announcement stored in the position information database under the control of a scheduler, a sound card and a video card for outputting the information of the database, and an advertisement control server for transmitting control signals to the character radio pager.

10 Claims, 13 Drawing Sheets

SYSTEM AND METHOD FOR PROVIDING USEFUL INFORMATION FOR A MOVING OBJECT

DESCRIPTION

1. Technical Field

The present invention relates to a multimedia data system and the method for providing the public with useful information, such as news, the weather forecast, traffic information, culture news, information for stock market, sports news, and a campaign for the public good, through a radio paging network, and for broadcasting stopping-places and transit areas and giving various kinds of information through both moving picture and still picture system.

2. Background Art

FIG. 1 is a block diagram illustrating a conventional character radio paging network, in which the reference numeral 11 denotes an information provider, 12 a radio paging character server, 13 a radio paging exchange station, 14 a radio paging base station, and 15 a character radio pager.

As shown in FIG. 1, the conventional character radio paging network includes: the information provider 11 which furnishes the public with useful information, such as news, weather forecast, traffic information, culture news, the information for stock market, sports news and a campaign for the public good; the radio paging character server 12 which receives information from the information provider 11 and then classifies them according to subscribers; the radio paging exchange station 13 which converts the classified information data from the radio paging character server 12 into transmission data which the character radio pager 15 can receive; the radio paging base station 14 which broadcasts the data inputted from the radio paging exchange station 13; and a character radio pager 15 which provides the public with information data transmitted from the radio paging base station 14.

FIG. 2 is a block diagram illustrating a conventional character radio pager in FIG. 1, in which there are shown a receiving antenna 21, a distributer 22, a receiving unit 23, a frequency synthesizer 24, a data processing unit 25, and a character indicator 26.

In the distributer 22, the character radio frequency received from the receiving antenna 21 is distributed to the receiving unit 23 and the frequency synthesizer 24. The frequency synthesizer 24 outputs a control signal for the receiving unit 23 to select a fixed channel. The receiving unit 23 demodulates the signal from the distributer 22, in response to the control signal of the frequency synthesizer 24. The data processing unit 25 outputs character-based information to user from the character indicator 25 by processing the output from the receiving unit 23.

In accordance with the illustrated conventional character-based radio paging network, there is a difficulty in securing a majority of customers on the view of network operator, thereby causing the profit to be diminished, and there is a hindrance in effectively using the limited frequency resources.

Therefore, it is necessary to create a new service for variously using the character-based radio paging network. Meanwhile, in the case that the driver directly fabricates an announcement about bus stop database through the operation by his hand, there is a problem making him be inattentive while driving, thereby threatening the passenger's safety.

DISCLOSURE OF INVENTION

An object of the invention is to provide a multimedia data service system and a method for proving the public with useful information such as news, the weather forecast, traffic information, culture information, the news for stock market, sports news, the campaign for the public good, etc. through the radio paging network by establishing multimedia terminal system. Thereby, the service of public transport can be surely improved by furnishing with both moving and still picture. In such a case, this invention is employed for a driver to be stopped from being inattentive while driving, thereby considering passengers' discomfort. Also, at the same time, the passenger's safety is provided by broadcasting the bus stop announcement through the received information from GPS receiver.

In accordance with an aspect of the present invention, there is provided a system for providing character-based information for a moving object, the system comprising: a first receiving means for receiving and demodulating position information indicating a present position thereof; a second receiving means for receiving and demodulating control information and character information from a character radio paging network providing the character-based information; a first store means for storing the character-based information received from the second receiving means; a second store means for storing the control signals received from the second receiving means and operator information directly inputted by an operator; a third store means for storing the position information according the movement of the moving object; a forth store means for storing an announcement for the present moving position of the moving object; a control means for extracting useful information from the first and second store means or extracting an announcement stored in the forth store means under the control of a scheduler in case where the position information received from the first receiving means is consistent with the position information stored in the third store means; an output means for outputting the information of the first, second and forth store means; and a remote control means for transmitting control signals to the second receiving means through the character radio paging network in order to remotely manage the information stored in the second store means.

In accordance with another aspect of the present invention, there is provided a system for providing character-based information for a moving object, the system comprising: a receiving means for receiving. and demodulating control information and character information from a character radio paging network providing the character-based information; a first store means for storing the character-based information received from the receiving means; a second store means for storing the control signals received from the receiving means and operator information directly inputted by an operator; a control means for extracting useful information from the first and second store means under the control of a scheduler; an output means for outputting the extracted information from the first and second store means; and a remote control means for transmitting control signals to the receiving means through the character radio paging network in order to remotely manage the information stored in the second store means.

In accordance with further aspect of the present invention, there is provided a method for providing useful information including character-based information for a moving object, the method comprising the steps of: storing operator information directly inputted by an operator, position information associated with a movement of a moving object, and announcement information for broadcasting a present moving position of the moving object, in a database; transmitting control information for the operator to manage the information stored in the database and character-based information through a character radio paging network; receiving control information and character-based information through the character radio paging network and storing the received control and character-based information in the database; receiving and demodulating present position information of the moving object; and extracting and outputting the operator information directly inputted by the operator or the character-based information, or extracting and outputting the announcement corresponding to the present position of the moving object in case where the present position of the moving object is consistent with moving object's position information stored in the database.

In accordance with still further aspect of the present invention, there is provided a method for providing useful information including character-based information for a fixed object, the method comprising the steps of: storing operator information directly inputted by an operator in a database; transmitting control information for the operator to remote control the information stored in the database and character-based information through a character radio paging network; receiving control information and character-based information through the character radio paging network and storing the received control and character-based information in the database; and extracting and outputting the operator information directly inputted by the operator or the character-based information.

In accordance with further aspect of the present invention, there is provided a system for providing character-based information for a moving object, the system comprising: a first receiving means for receiving and demodulating position information indicating a present position an moving object; a second receiving means for receiving and demodulating control information and character-based information from a character radio paging network providing the character-based information; a first store means for storing the character-based information received from the second receiving means; a second store mean for storing picture information to be used as a background picture when the character-based information is outputted; a third store means for storing the control signals received from the second receiving means and operator information directly inputted by an operator; a fourth store means for storing the position information from the movement of the moving object; a fifth store means for storing an announcement for the present moving position of the moving object; a sixth store mean for storing picture information to be used as a background picture when the announcement is outputted; a control means for extracting useful information from the first, second and third store means or extracting the announcement stored in the fifth and sixth store means under the control of a first scheduler in case where the position information received from the first receiving means is consistent with the position information stored in the fourth receiving means; an output means for outputting the information stored in the first, second, third, fifth and sixth store means; a third receiving means for receiving character-based information from an external provider; a seventh store means for storing the character-based information received, from the third receiving means and control information from an external operator; and a transmitting means for extracting the character-base and control information stored in the seventh store means and outputting the character-base and control information stored in the seventh store means to the second receiving means in response to a second scheduler.

In accordance with still further aspect of the present invention, there is provided a system for providing character-based information for a moving object, the system comprising: a first receiving means for receiving and demodulating control information and character-based information from a character radio paging network providing the character-based information; a first store means for storing the character-based information received from the first receiving means; a second store mean for storing picture information to be used as a background picture when the character-based information is outputted; a third store means for storing the control signals received from the first receiving means and operator information directly inputted by an operator; a control means for extracting and outputting useful information from the first, second and third store means in response to a first scheduler; an output means for outputting the information stored in the first, second and third store means; a second receiving means for receiving character-based information from an external provider; a fourth store means for storing the character-based information received from the second receiving means and control information from an external operator; and a transmitting means for extracting the character-base and control information stored in the seventh store means and outputting the character-base and control information stored in the fourth store means to the first receiving means in response to a second scheduler.

BRIEF DESCRIPTION OF THE DRAWINGS

Other objects and aspects of the invention will become apparent from the following description of embodiments with reference to the accompanying drawings, in which.

BEST MODE FOR CARRYING OUT THE INVENTION

Hereinafter, the first embodiment of the present invention will be described in detail referring to FIGS. 3 to 6.

Figure 1:
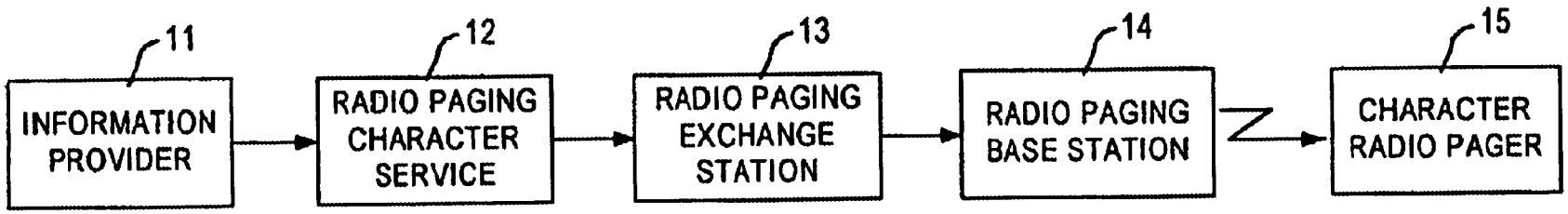
FIG. 1 is a block diagram illustrating a conventional character radio paging network.
Figure 2:
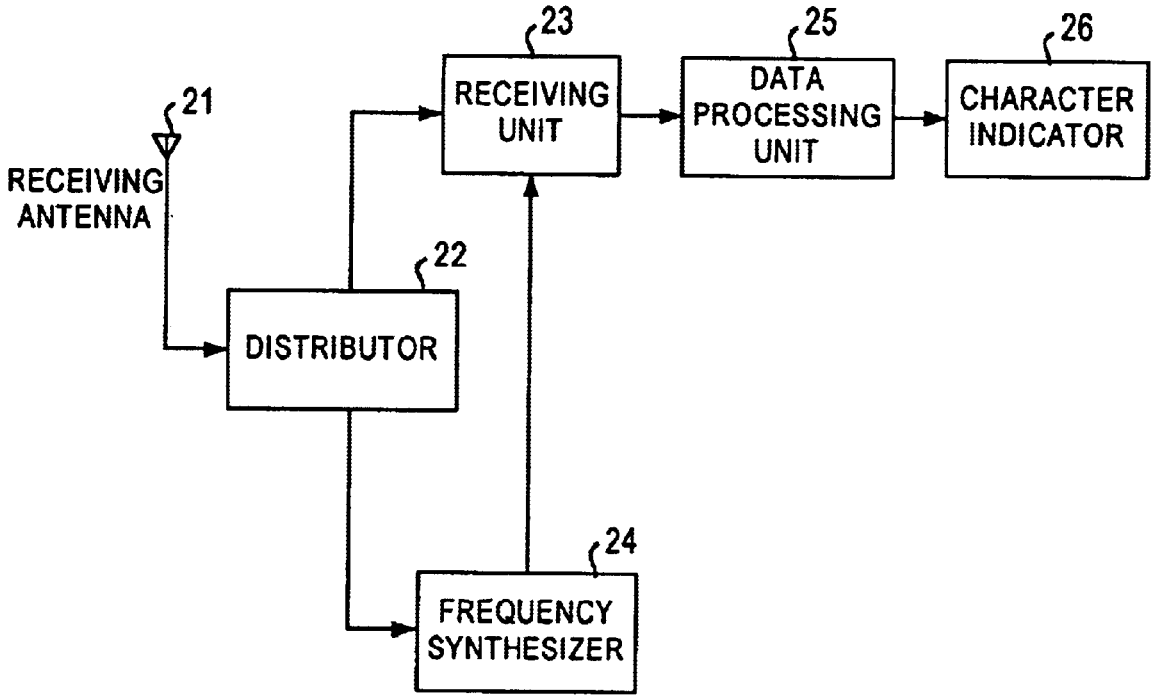
FIG. 2 is a block diagram illustrating a conventional character radio pager in FIG. 1.
Figure 3:
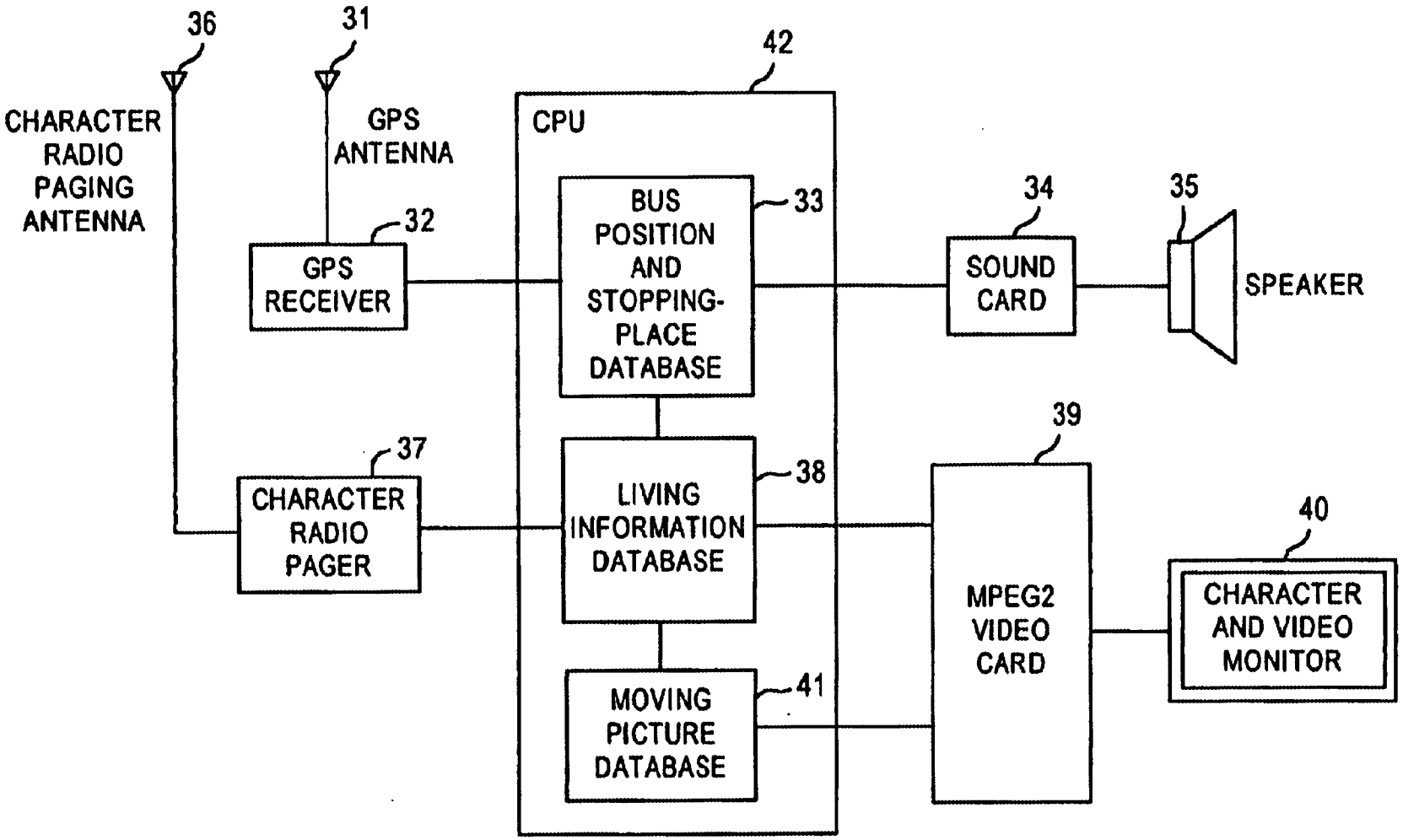
FIG. 3 is a block diagram illustrating a multimedia terminal according to the first embodiment of the present invention.
Figure 4:
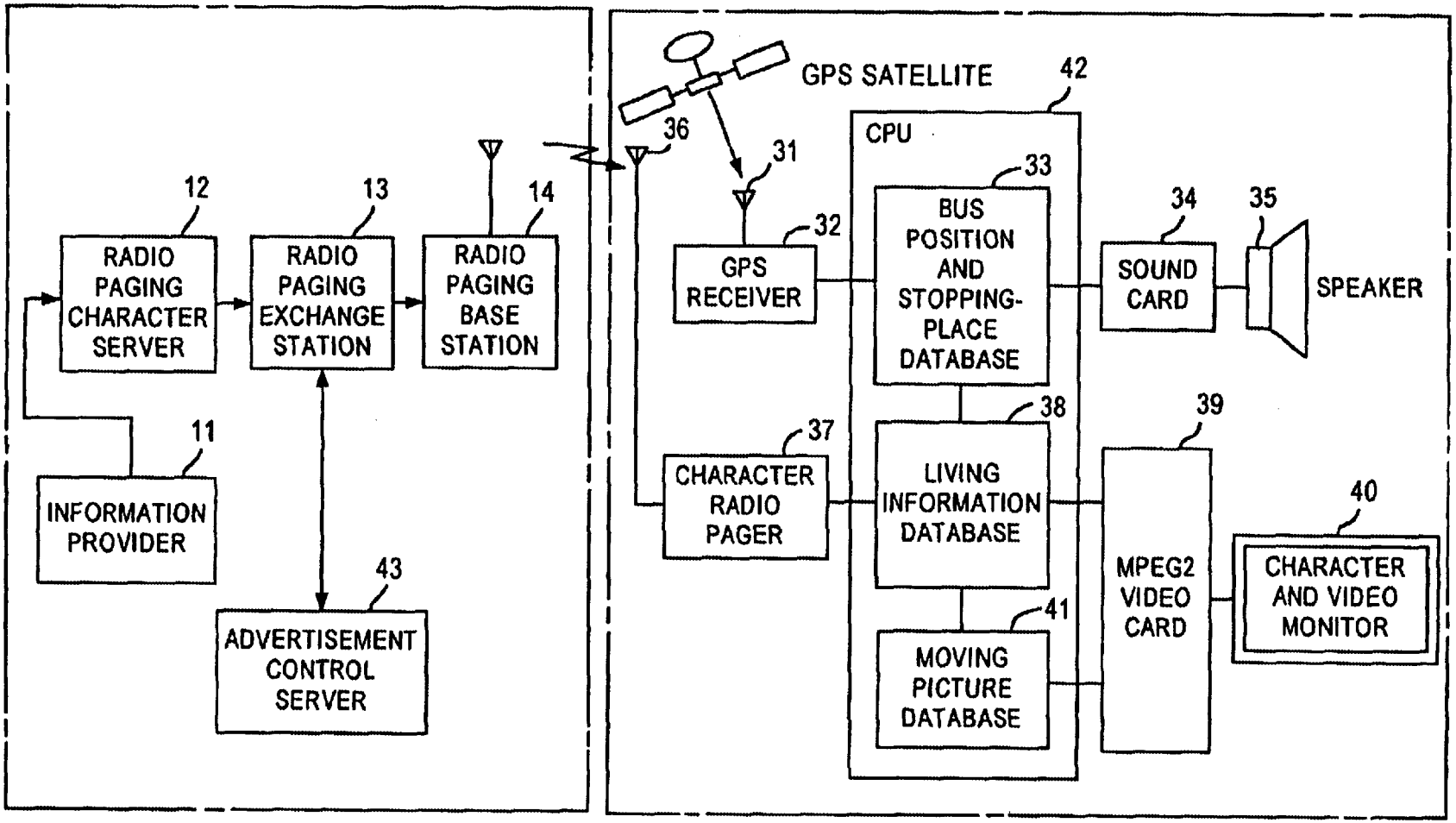
FIG. 4 is a block diagram illustrating a system for providing multimedia information to subscribers according to the first embodiment of the present invention.

First, FIG. 3 is a block diagram illustrating a multimedia terminal according to the first embodiment of the present invention and FIG. 4 is a block diagram illustrating a system for providing multimedia information to subscribers according to the first embodiment of the present invention.

In FIGS. 3 and 4, the reference numeral 31 denotes a GPS (Global Positioning System) antenna, 32 a GPS receiver, 33 a bus position and stopping-place database relative to the bus position by its routes and to the stopping-place information of the bus, 34 a sound card, 35 a speaker, 36 a radio paging antenna, 37 a character radio pager for receiving character-based information, 38 a living information database, 39 an MPEG2 (Moving Pictures Expert Group 2) video card, 40 a monitor, 41 a moving picture database such as advertisements, 42 a CPU and 43 an advertisement control server.

To notify passengers of the bus stop, the GPS receiver 32, with which a bus is loaded, receives GPS information from a GPS satellite through the GPS antenna 31 in a moving picture multimedia terminal (MMT) and then demodulates the received GPS information.

The CPU 42 receives the demodulated information from the GPS receiver 32. At this time, if the received. information by the CPU 42 has position information (hereinafter, referred to as broadcast-required position information) corresponding to the position in which an announcement about the bus stop should be provided to the passengers, the CPU 42 retrieves the bus position and stopping-place database 33 according to a control program, and then the extracted announcement about the bus stop is outputted to the sound card 34 and the MPEG2 video card 39 when an offer of other information, which is being outputted, comes to an end.

The sound card 34 converts the output from the CPU 42 into voice signals and then provides the announcement to the passengers via the speaker 35.

The MPEG2 video card 39 converts the output from the CPU 42 into video signals so that it provides the position information in and around the bus stop for the passengers via the monitor 40.

The character radio pager 37 receives radio frequency (living information including a new flash and control signals) based on the characters through the radio paging antenna 36 and demodulates the received radio frequency.

On the other hand, the CPU 42 receives the living information and control signals from the radio pager 37. At this time, after the CPU 42 stores them in the living information database 38 including the character-based information and the moving picture database 41 according to the system control programs, in the case where there are not received a news flash and broadcast-required position information, the CPU 42 retrieves the living information database 38 and the moving picture database 41, and then outputs the living information and the moving picture information to the MPEG2 video card 39.

Furthermore, since the moving picture database 41 is in need of a large quantity of information, the moving picture information is not transmitted through the radio paging network. Accordingly, the CPU 42 stores the moving picture information in a multimedia system such that the CPU 42 remotely manages and controls which advertisements are broadcasted and how many advertisements are broadcasted via advertisement control server 43 coupled to the radio paging exchange station 13. In addition, the living information database 38 is made up of various data in connection with the living information.

The bus position and stopping-place database 33 is built up by previously and substantially examining the position coordinates of the bus routines and by correcting distance errors caused by topography such as an underground passage which makes the correct measurement of the position coordinates impossible.

Figure 5:
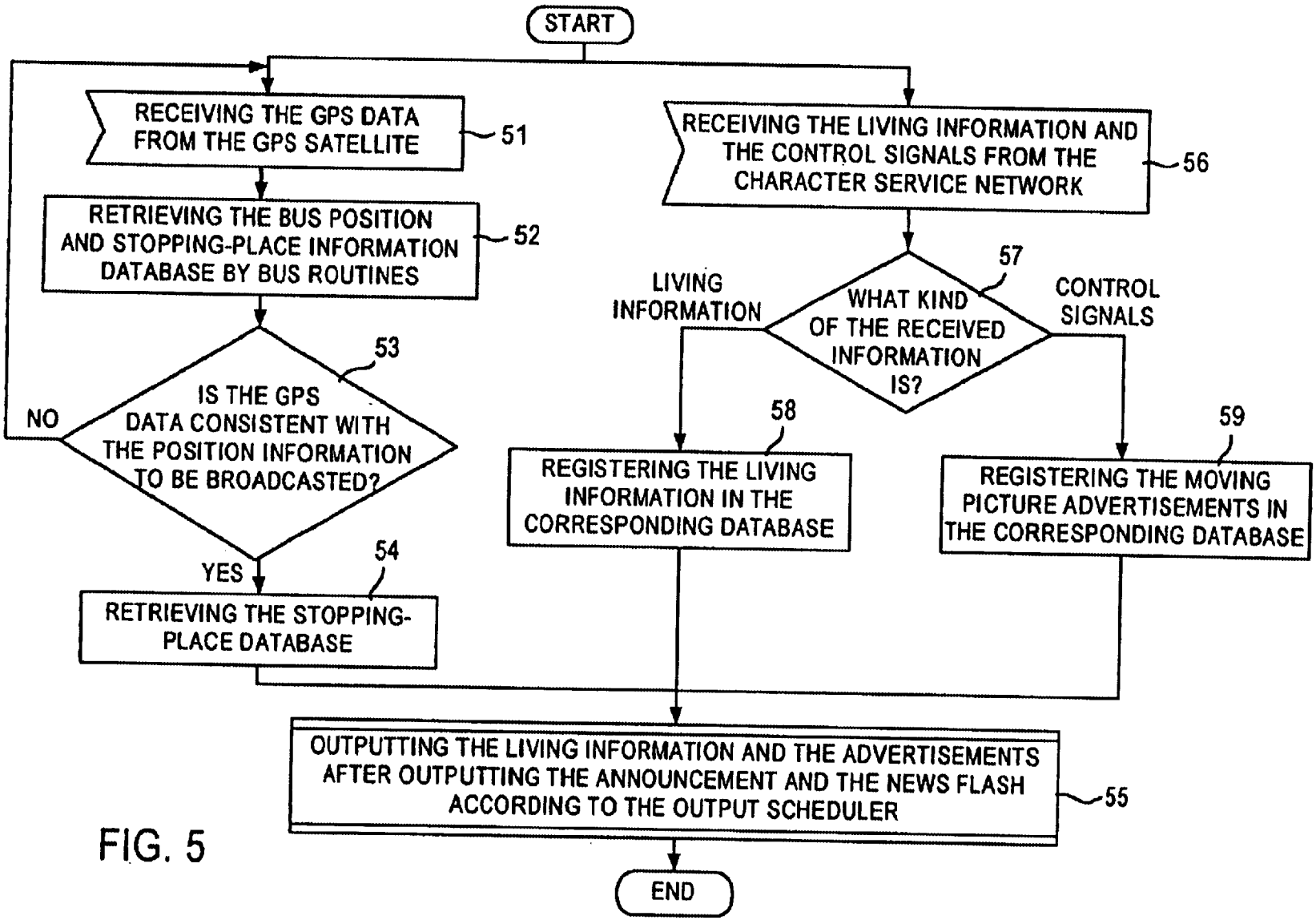
FIG. 5 is a flow chart illustrating the multimedia system to provide information for the subscribers according to the first embodiment of the present invention.

FIG. 5 is a flow chart illustrating the multimedia system to provide information for the subscribers according to the first embodiment of the present invention.

First, in the case where the GPS receiver 32 receives the GPS data from the GPS satellite at step 51, the CPU 42 retrieves the bus position and stopping-place database, which is already provided to the multimedia system of the present invention, at step 52 such that the CPU 42 determines whether the received GPS data from the GPS satellite is consistent with the position information to be broadcasted or not, at step 53.

If the received GPS data from the GPS satellite is not consistent with the position information to be broadcasted, the GPS receiver repeatedly carries out the step of receiving the GPS data from the GPS satellite. On the other hand, if the received GPS data is consistent with the position information to be broadcasted, the CPU retrieves the bus position and stopping-place database for the announcement of the bus stop, and then outputs the related information at step 54.

Next, at step 55, after outputting the bus stop information and the new flash under the control of the output scheduler, the living information and the moving picture information are outputted. That is, after the output of the living information and the moving picture information are delayed, for example, for 30 seconds until the living information and advertisements, which is being outputted, comes to an end, the announcement is promptly outputted in voice signals and the position information in and around the bus stop is simultaneously outputted to the passengers via monitor.

On the other hand, if the CPU 42 receives the living information and the control signals from a character service network providing the living information at step 56, the CPU 42 estimates the kind of the received information at step 57. The living information is registered in the living information database 38 at step 58 and also the control signals are registered in the moving picture database at step. 59.

After outputting the announcement of bus stop and the news flash under the control of the output scheduler, the living information. and the moving picture information are outputted at step 55. Similarly, in the case where there are not received the broadcast-required position information and a news flash, the living information database 38 and the moving picture database 41 are retrieved, and then the living information and the moving picture information are outputted to the MPEG2 video card 39.

Figure 6:
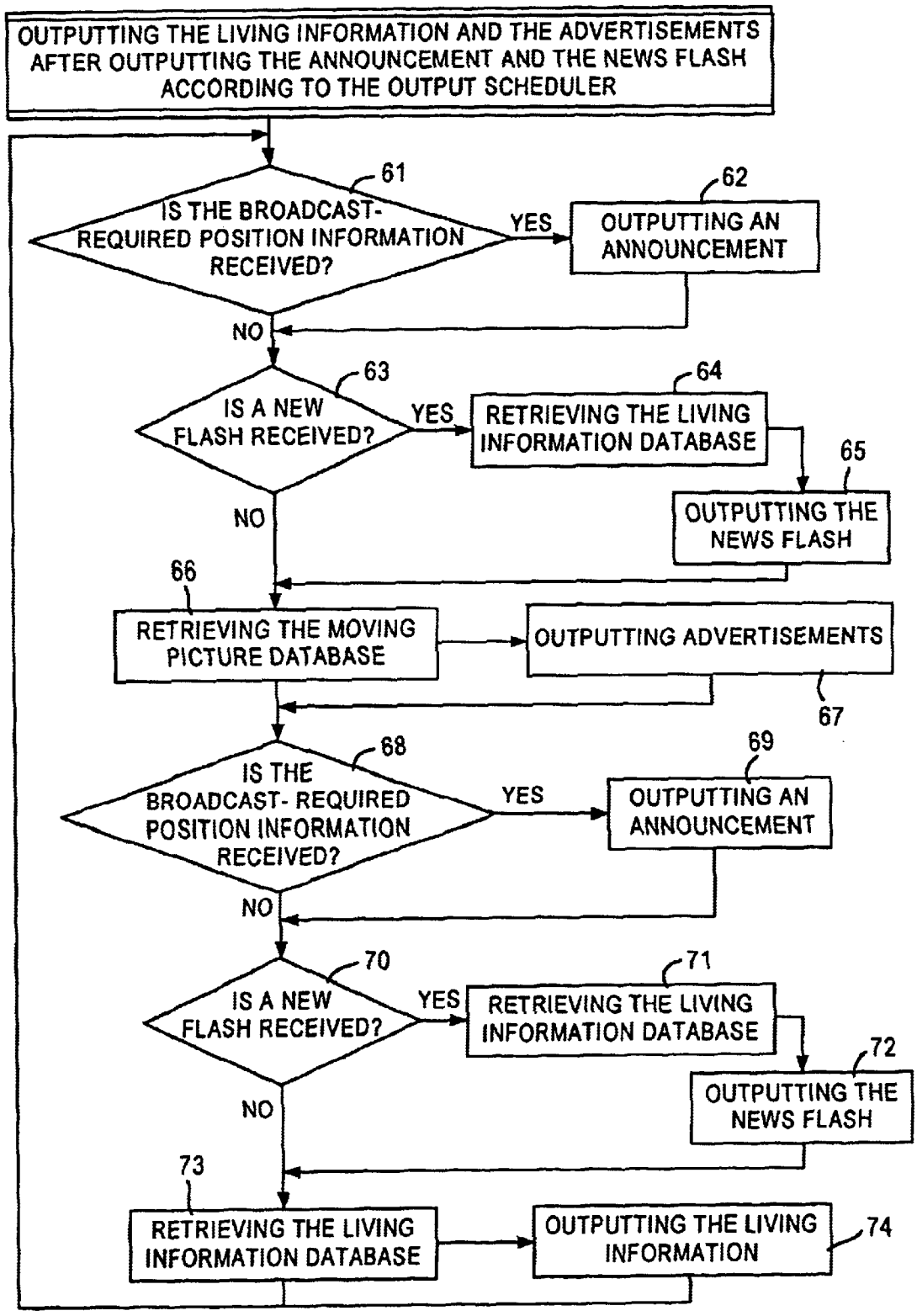
FIG. 6 is a flow chart illustrating the output of the information according to the output control scheduler in FIG. 5.

FIG. 6 is a flow chart illustrating the output of the information according to the output control scheduler in FIG. 5.

According to the present invention, the CPU processes the bus stop information and the news flash in preference to any other information such as the advertisements, weather conditions, stocks and the like.

First, the CPU ascertains whether the broadcast-required position information is received at step 61, and then outputs the announcement in voice and video signals at step 62 if the broadcast-required position information has been received.

In the case where the broadcast-required position information has not been received or after the broadcast-required position information is outputted, the CPU ascertains whether the news flash is received at step 63, and then retrieves the living information at step 64 if the news flash has been received. Considering that the passengers are uncomfortable, the voice information may not be provided.

At step 66, the CPU 42 retrieves the moving picture database in the case where the news flash has not been received or the new flash has been outputted, and then outputs the predetermined advertisements at step 67.

Next, the CPU 42 ascertains whether the bus stop information is received at step 68, and then outputs the information related to the bus stop in voice and video signals at step 69 if the broadcast-required position information has been received.

The CPU 42 ascertains whether the news flash has been received at step 70 in the case where the broadcast-required position information has not been received or after the announcement has been outputted. At this time, in the case where the news flash has been received, the CPU 42 retrieves the living information database at step 71 and then outputs the news flash to the monitor at step 72.

In the case where the news flash has not been received or after the news flash has been outputted, the CPU 42 retrieves the living information database at step 73 and then outputs to the monitor various kinds of information, such as news, weather conditions, stocks, sports and the like, at step 74. However, the phonetic sounds may not be given in consideration of safety driving and passengers discomfort. Continuously, the CPU 42 repeatedly performs the step of ascertaining whether the broadcast-required position information has been received.

As stated above, the first embodiment of the present invention is applicable to other public transports, such as a subway and a train provided the database of the position coordinates related to the position of the a stopping-place and the GPS receiver are modified, and the transports are equipped with them.

In other words, the train may be in need of the same elements as the bus provided that the database of the position coordinates is modified. In addition, the train may provide information only about its periphery corresponding to its route. Further, the information providing system used in the bus can be applicable to the subway, however the subway station must have a pulse generating equipment, and the train must have a pulse receiver because the GPS wave is not propagated into the underground.

If the pulse receiver mounted on the train receives a pulse generated by the pulse generating equipment set up in the subway station, for example, an underground tunnel, the train provides an announcement about next station to passengers, of course, in the case where there is not provided information about the next station, the train may display various kinds of information, such as weather conditions, advertisements, sports, and the like.

In the case where the present invention is employed only in a fixed place, the present invention can output only video information without voice information with the removal of the corresponding GPS equipments and other equipments which are necessary to provide the announcement of a stopping-place, of course, it is also possible to provide the voice information when the video information has been providing to the passengers.

The second embodiment of the present invention will be described in detail referring to FIGS. 7 to 12.

Figure 7:
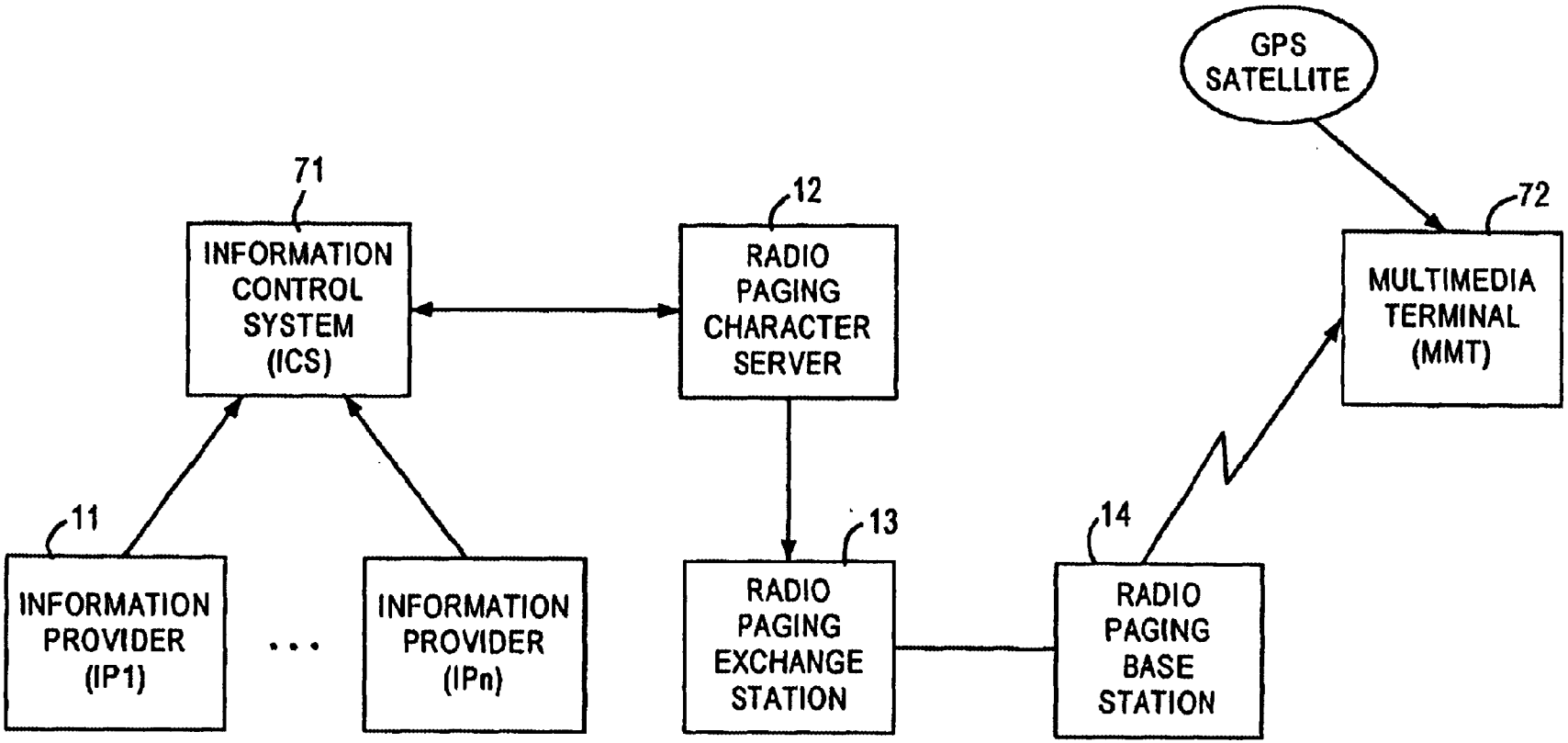
FIG. 7 is a schematic block diagram illustrating a system for providing multimedia information according to the second embodiment of the present invention.

FIG. 7 is a schematic block diagram illustrating a system for providing multimedia information according to the second embodiment of the present invention, in which the reference numeral 71 denotes as information control system (ICS), 72 a multimedia terminal (NMT).

First, after the ICS 71 receives the living information from the information providers 11 and processes the received living information, the ICS 71 transmits the living information and control information to the radio paging character server 12. The radio paging character server 12, which received the processed living information and the control information, classifies the living information by subscribers, and then transmits the information to the MMT 72 through the radio paging exchange station 13 and the radio paging base station 14.

On the other hand, the MMT 72 receives and stores the transmitted living information and control information, and also receives the information about the GPS position coordinates from the GPS satellite, thereby displaying various kinds of information according to the control program of the schedule system after comparing the GPS position information with the bus position and stopping-place database by bus routines.

Figure 8:
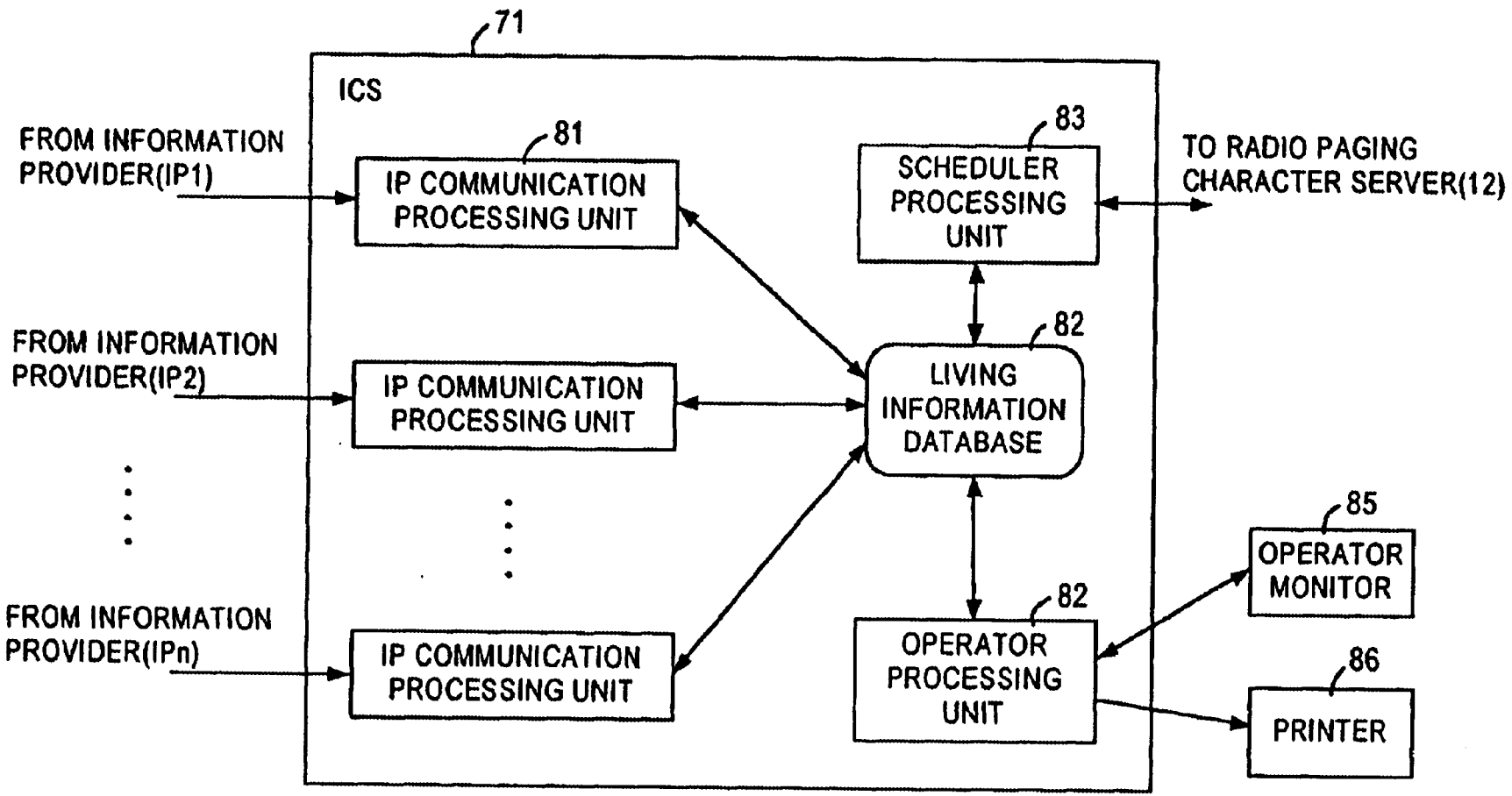
FIG. 8 is a block diagram illustrating the ICS in FIG. 7.

FIG. 8 is a block diagram illustrating the ICS in FIG. 7. In FIG. 8, the reference numeral 81 denotes an information provider(IP) communication processing unit, 82 a living information database, 83 a scheduler processing unit, 84 an operator processing unit, 85 an operator monitor and 86 a printer.

First, the IP communication processing unit 81 receives the living information from the information provider 11 and then stores the received living information in the living information database 82.

The operator processing unit 84 may control and drive all modules in the ICS 71 under the control of the operators, by outputting the various kinds of state information to the operators. That is, since the operators can know all states processing the internal modules in operation, it is possible to control all the internal modules. Also, The operator processing unit 84 provides the operator with processing pictures, in which the operator can determine methods used in transmitting data, and can determine a period of store of the living information in the database. Furthermore, the operator processing unit 843 can make inquiries about the particulars of the transmission/receiving of the living information by items, days and months, also make inquiries about the various particulars of the moving and still picture information by the established multimedia terminals and various kinds of information. In the text information, the operator controls the size, kind, style and color of font and their arrangement method and the operator processing unit 84 provides a GUI(Graphic User Interface) picture for indicating a background picture.

The scheduler processing part 83 first reads the number of pager for receiving the information according to its transmission region and transmission methods according to information items, and the their periods, and then stores them. The scheduler processing part 83 reads the living information and the moving and still picture control information by periodically accessing the living information database. At this time, after indicating the different transmission methods and then processing the data, the operator transmits the processed data to the radio paging character server 12.

The transmission method can be selected from the periodic transmission method to periodically transmit data at a fixed period, the immediate transmission method to immediately transmit data as soon as the data is received, the repeated transmission method to repeatedly transmit a specific item by the predetermined number of time, the batch transmission method to transmit a specific item group in a lump and the selective transmission method to selectively transmit data in response to the predetermined methods.

Since there is an information packet transmitted from the information control system 71 to the radio paging character server 12 and a response packet transmitted from the radio paging character sever 12 to the information control system 71, it is possible to correct the information packet in which there is an error. The data of the information packet includes the name of information item, an information item code, an information provider, a transmission method, a background picture and contents of the information. Also, the transmission may be determined by information item codes, and more particularly by established media and regions.

As stated above, the processed information in the operator processing part 84 is stored in the living information database 82 and then transmitted to the MMT 72 through the radio paging network 12, 13 and 14 in response to the scheduler processing part 83.

Figure 9:
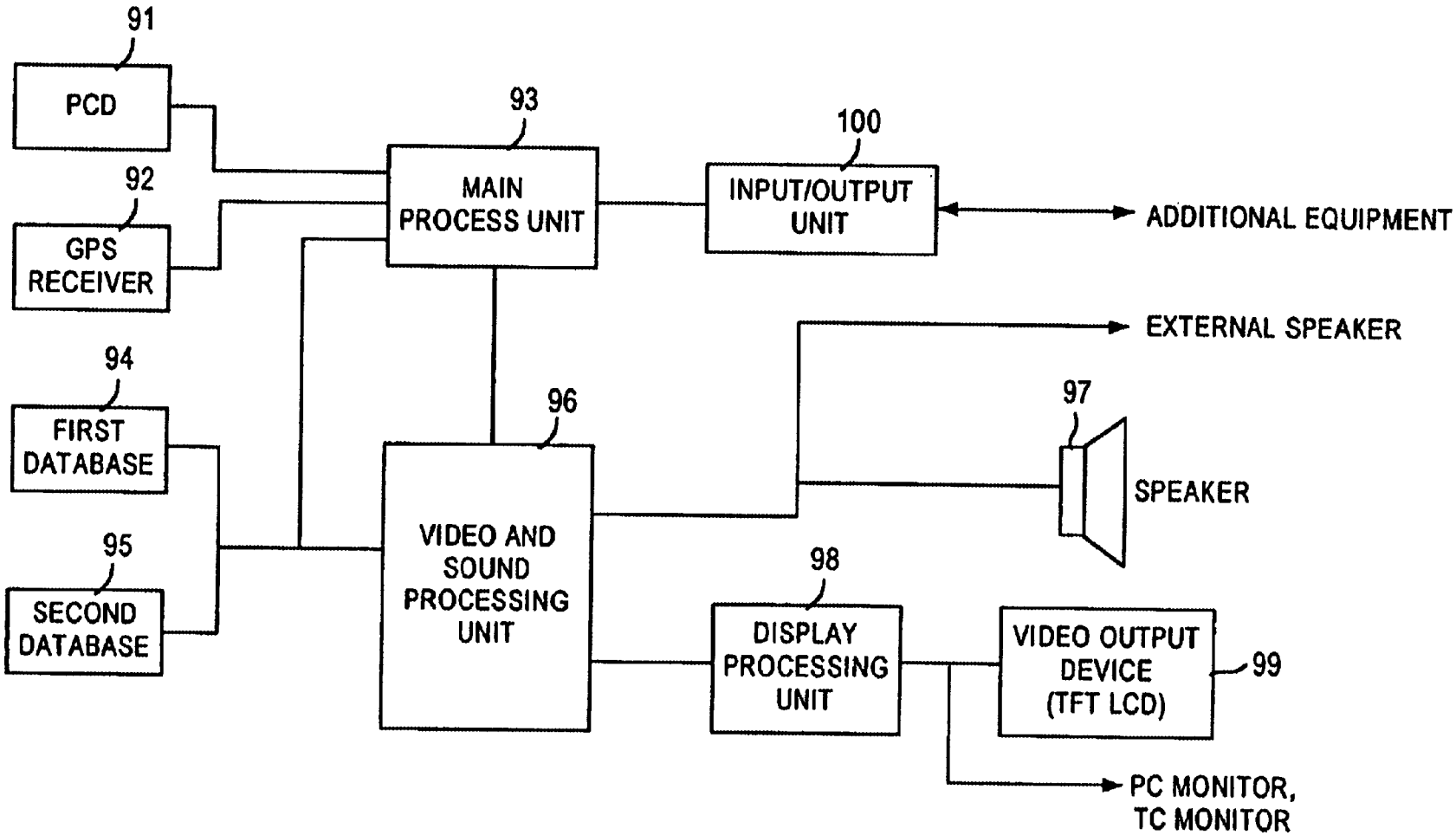
FIG. 9 is a block diagram illustrating the MMT according to the second embodiment of the present invention.
Figure 10A:
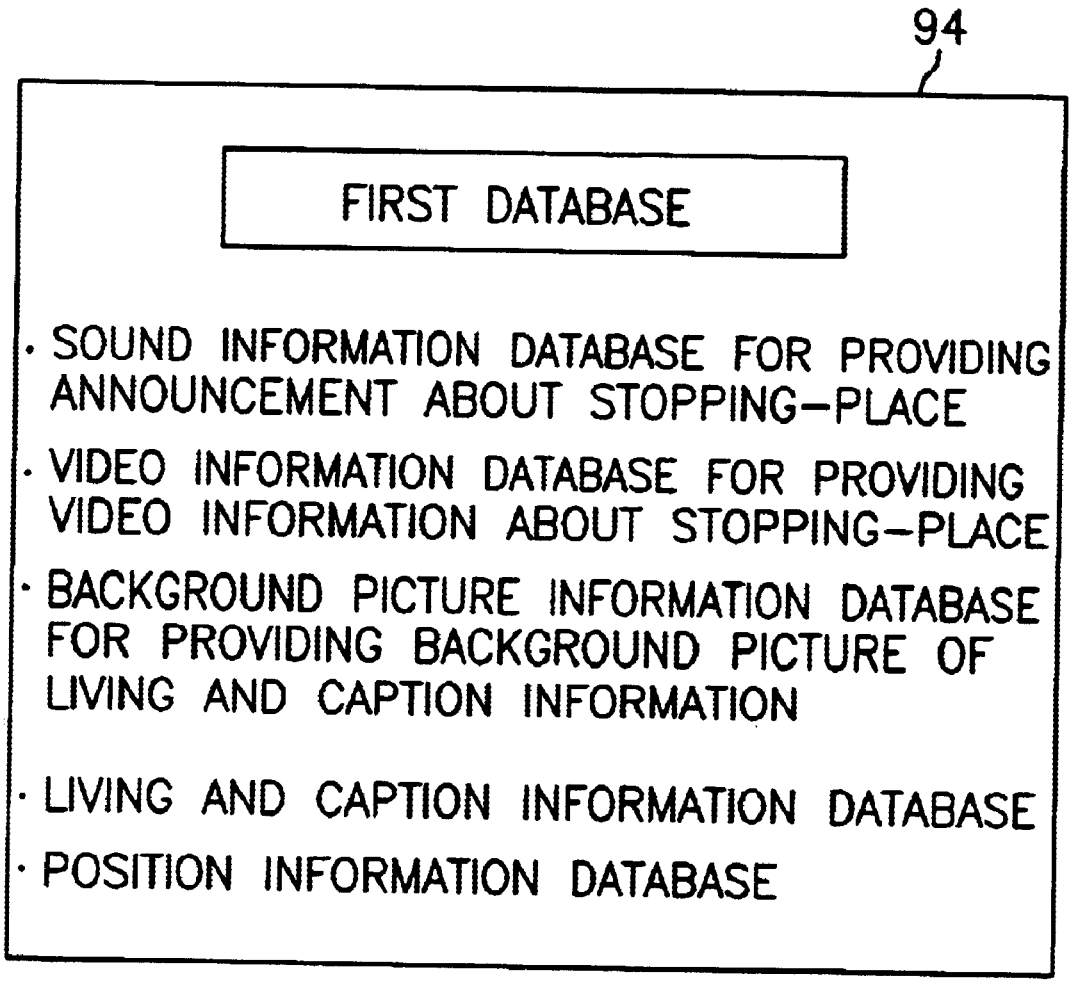
FIGS. 10A and 10B are block diagrams illustrating the databases according to the second embodiment of the present invention.
Figure 10B:
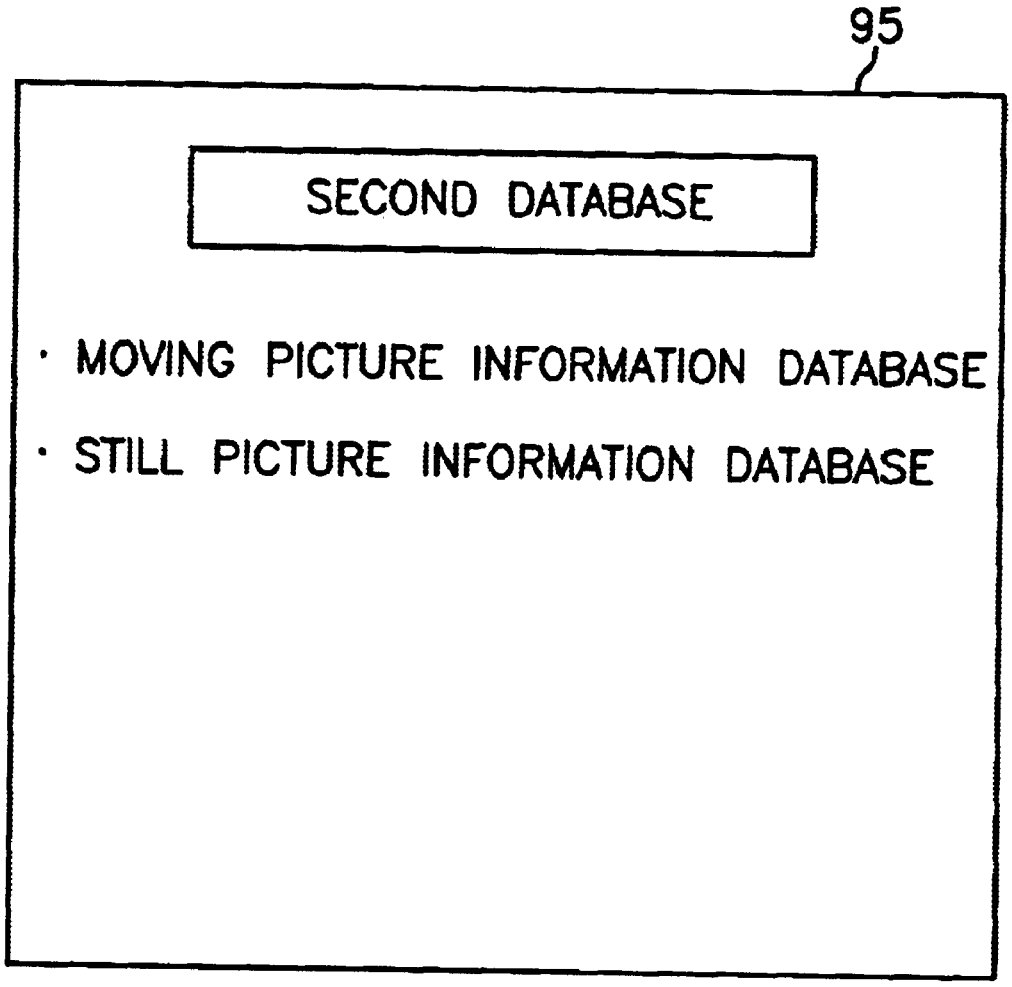

FIG. 9 is a block diagram illustrating the MMT according to the second embodiment of the present invention and FIGS. 10A and 10B are block diagrams illustrating the databases according to the second embodiment of the present invention. In FIGS. 9, 10A and 10B, the reference numeral 91 denotes a PCD(Paging Network Connection Device), 92 a GPS receiver, 93 a main processor unit (MPU), 94 a first database, 95 a second database, 96 a video and sound processing unit, 97 a speaker, 98 a display processing unit, 99 a video output device (TFT LCD) and 100 an input/output unit.

The PCD 91 of the MMT 72 receives from the information control system 71 the living information, the caption information, the moving/still picture control information and the like, and processes them, and then transmits effective information to the MPU 93. On the other hand, the GPS receiver 92 receives and demodulates the GPS information from the GPS satellite, and then transmits the position information to the MPU 93.

The MPU 93 controls the entire operation of the MMT 72 at real time operation and carries out all operations of job scheduling. If there exist the position information received from the GPS receiver 92 in the established position coordinate information database about a stopping-place, the MPU 93 retrieves the first database 94, for example, the video and voice information database for the stopping-place information corresponding to the received position coordinate, and then, when the output of other information comes to an end, immediately outputs the corresponding announcement to the display processing part 98 in order that the passengers can show the corresponding information through the video output device 99 and/or the speaker 97. At this time, it is possible to minimize errors caused by obstacles such as buildings in the downtown area, by using an adaptive algorithm.

In addition, the MPU 93 stores the living and caption information received from the PCD 91 in the living and caption information database of the first database 94, and stores the moving and still picture control information in the moving picture information database and the still picture information database of the second database, respectively. In the case where there is no broadcast-required position information received from the GPS receiver in the established position information database about the bus routine, the MPU 93 respectively extracts the various kinds of living information and the previously stored picture information from the first database, which includes the living and caption information database and the background picture database for the living and caption information, and the second database, which includes the moving and still picture information database, in order of the job scheduling of the MPU 93. Next, the MPU 93 processes the information extracted from the video and sound processing unit 96 and then outputs the extracted information to the video output device (TFT LCD) 99. Before the video information is outputted to the video output device 99, the display processing unit 98 processes the video information to be matched with the output device. Accordingly, the present invention can use the TV monitor and VGA PC monitor as well as TFT LCD.

On the other hand, after receiving the video and voice information and processing it, the video and sound processing unit 96 outputs the voice information to the speaker 97 or an external speaker and outputs the video information to the display processing unit 98.

The living and caption information in the data received from the PCD 91 are respectively stored in the living and caption information database of the first database 94. Also, as shown in FIGS. 10A and 10B, the first database 94 includes the voice information database for providing an announcement about stopping-places, the video information database for providing the video information of stopping-places and their outskirts, the background picture information database for providing the background pictures of the living and caption information, the living and caption information database for providing the passengers with useful information, and the position information database for recognizing the position of the bus routine on the coordinate system. The second database 95 includes the moving and still picture information database for providing the video information such as advertisements.

The read/write/clear operations are allowed to be executed in the first and second database through the MPU 93 and the input/output unit 100. The update of database is carried out by two methods, one of which is to update the database through the input data from the input/output unit 100 under the control of the MPU 93, and the other of which is to update the database through the replacement of the database.

On the other hand, since the moving and still picture information database has a very large amount of data, the data is not transmitted through the radio paging network but directly stored in the multimedia terminal. The management of the database is remote controlled by the radio paging character server 12 based on the character service network of the living information. That is, the operator manages which advertisements are to be broadcasted and how many times advertisement are to be broadcasted through the radio paging character server 12. Further, the database associated with the living information may be established according to the different kinds of living information.

Figure 11:
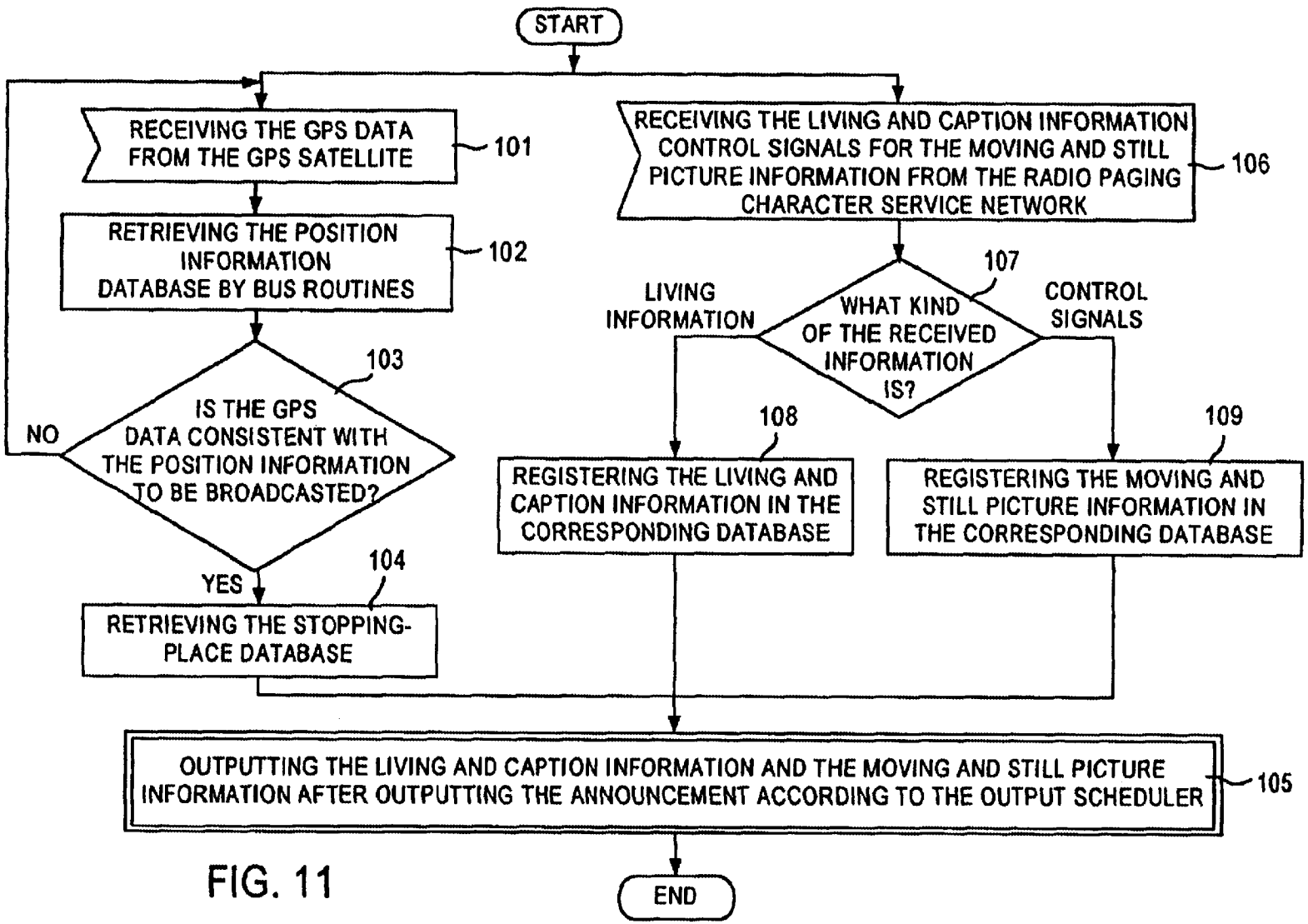
FIG. 11 is a flow chart illustrating the multimedia system to provide information to the subscribers according to the second embodiment of the present invention.

FIG. 11 is a flow chart illustrating the multimedia system to provide information to the subscribers according to the second embodiment of the present invention.

First, in the case where the GPS data is received from the GPS satellite at step 101, the MPU 93 retrieves the position information database by bus routines at step 102 such that the MPU 93 determines whether the received GPS information from the GPS satellite is consistent with position information to be broadcasted or not, at step 103.

If the received GPS information from the GPS satellite is not consistent with the position information to be broadcasted, the GPS receiver repeatedly carries out the step of receiving the GPS information from the GPS satellite. On the other hand, if the received GPS information from the GPS satellite is consistent with the position information to be broadcasted, the MPU 93 retrieves the stopping-place database and then extracts the related announcement at step 104.

Next, after outputting the announce of stopping-place under the control of the job scheduling of the MPU, the living information, the caption information, and the moving and still picture information are outputted at step 105. That is, after the output of the corresponding information are delayed, for example, for 30 seconds until the information, which is being outputted, comes to an end, the announcement of stopping-place is promptly outputted in voice signals and the picture information in and around the stopping-place is simultaneously outputted to the passengers via the monitor.

On the other hand, if the MPU 93 receives the character and caption information and the control signals for the picture information from a radio paging character service network providing the living information at step 106, the MPU 93 estimates the kind of the received information at step 107. In the case of the living and caption information, this information is registered in the living and caption information database at step 108 and, in the case of the control signals, the control signals are registered in the moving and still picture database at step 109.

After outputting the announcement of the stopping-place under the control of the job scheduling of the MPU 93, the living and caption information and the moving and still picture information are outputted at step 105. That is, in the case where there is not received the broadcast-required position information, the living and caption information database and the moving and still picture database 41 are retrieved, and then the living information, the caption information and the moving and still picture information are outputted to the monitor.

Figure 12:
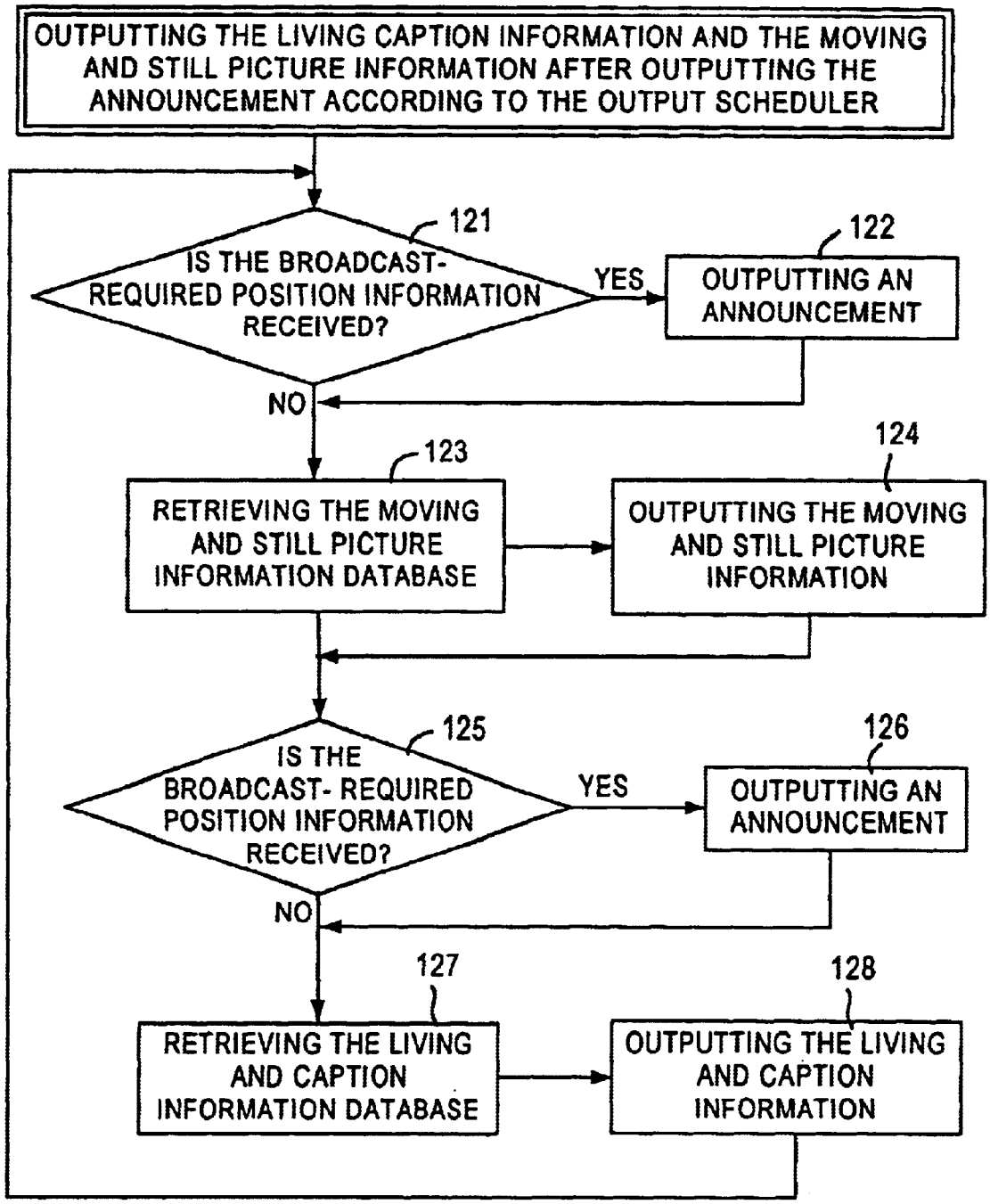
FIG. 12 is a flow chart illustrating the output of the information according to the output control scheduler in FIG. 11.

FIG. 12 is a flow chart illustrating the output of the information according to the output control scheduler in FIG. 11.

The MPU 93 processes the stopping-place information in preference to any other information such as the moving and still picture information, the living and caption information.

First, the MPU 93 ascertains whether the broadcast-required position information is received at step 121 and then outputs the announcement of the stopping-place in voice and video signals at step 122 if the broadcast-required position information is received.

In the case where the broadcast-required position information is not received or after the broadcast-required position information is outputted, the MPU 93 retrieves the moving and still picture information database at step 123 in response to the job scheduling, and then outputs the moving and still picture information to the monitor at step 124. Considering that the passengers are uncomfortable, the voice information may not be provided.

The MPU 93. ascertains again whether the broadcast-required position information of the stopping-place is received at step 125, and then outputs the announcement to the passengers in voice and/or video signals at step 126 if the broadcast-required position information is received.

In the case where the broadcast-required position information has not been received or after the broadcast-required position information has been outputted, the MPU 93 retrieves the living and caption information database at step 127, and then outputs to the monitor various kinds of information, such as new, weather conditions, stocks, sports and the like, at step 128. However, the phonetic sounds are not given in consideration of safety driving and passengers' discomfort. Continuously, the MPU 93 repeatedly performs the step of ascertaining whether the bus stop information has been received.

As stated above, the second embodiment of the present invention is applicable to other public transports such as a subway and a train provided that the database of the position information related to the position of the bus stop and the GPS receiver are modified and the public transports are equipped with them.

In other words, the train may be in need of the same elements as the bus provided the database of the position information is modified. In addition, the train may provide information only about its periphery corresponding to its route. Further, the information providing system used in the bus can be applicable to the subway, but the subway station must have a pulse generating equipment and also the train must have a pulse receiver because the GPS frequency is not propagated into the underground.

If the pulse receiver mounted on the train receives a pulse generated by the pulse generating equipment set up in the subway station, for example, an underground tunnel, the train provides information about next station to passengers, of course, in the case where there is no an announcement about next station, the train may display various kinds of information, such as weather conditions, advertisements, sports, and the like.

In the case where the present invention is employed only in a fixed place, the present invention can output only video information without voice information with the removal of the corresponding GPS equipments and other equipments necessary to provide the bus stop information, of course, it is also possible to provide the voice information when the video information has been provided to the passengers.

According to the present invention, as the above described, the automatic announcement service just in the bus about bus position and stopping-place can make the driver concentrate on safety-driving due to GPS satellite, while he cannot pay attention to driving carefully, with the announcement operated by his own hands. As a result of that, both passenger's safety and the traffic safety regulations are guaranteed, and a good qualified service for both passengers and traffic officers of a local autonomous entity is provided. Moreover, there are both useful information to passengers and operator's obtainable profits through other information such as advertisement.

What is claimed is:

1. A system for providing character-based information for a moving object, the system comprising:

first and second scheduler;

a first receiving means for receiving and demodulating present position information indicating a present position of the moving object;

a second receiving means for receiving and demodulating control information and character-based information from a character radio paging network providing the character-based information;

a first store means for storing the character-based information received from the second receiving means;

a second store means for storing picture information to be used as a background picture when the character-based information is outputted;

a third store means for storing control signals received from the second receiving means and operator information directly inputted by an operator;

a fourth store means for storing previously generated position information related to a travel of the moving object;

a fifth store means for storing an announcement for the present moving position of the moving object;

a sixth store means for storing picture information to be used as a background picture when the announcement is outputted;

a control means for extracting useful information from the first, second and third store means or extracting the announcement stored in the fifth and sixth store means under control of the first scheduler in case where the present position information received from the first receiving means is consistent with the previously generated position information stored in the fourth store means;

an output means for outputting the information stored in the first, second, third, fifth and sixth store means;

a third receiving means for receiving character-based information from an external provider;

a seventh store means for storing the character-based information received from the third receiving means and control information from an external operator; and a transmitting means for extracting the character-based and control information stored in the seventh store means and outputting the character-based and control information stored in the seventh store means to the second receiving means in response to a the second scheduler.

2. A system in accordance with claim 1, wherein the first receiving means comprises a GPS receiver for receiving and demodulating the present position information received from a GPS satellite.

3. A system in accordance with claim 1, wherein the first receiving means comprises a pulse receiver for measuring distance, wherein the pulse receiver receives distance majoring pulses from a pulse generator and demodulates the present position information.

4. A system in accordance with claim 1, wherein the output means comprises:

a voice and picture information processing means for processing the voice and picture information in the first second, third, fifth and sixth store means;

a voice output means for outputting the voice information received from the voice and picture information processing means;

a display processing means for determining a display type of the picture information received from the voice and picture information processing means; and a picture output means for outputting the picture information received from the display processing means.

5. A system in accordance with claim 4, wherein, the operator information that is stored in the third store means, and directly inputted by the operator comprises moving and still picture information.

6. A system in accordance with claim 5, wherein the moving object is one of public transports.

7. A system for providing character-based information for a moving object, the system comprising:

first and second schedulers;

a first receiving means for receiving and demodulating control information and character-based information from a character radio paging network providing the character-based information;

a first store means for storing the character-based information received from the first receiving means;

a second store means for storing picture information to be used as a background picture when the character-based information is outputted;

a third store means for storing control signals received from the first receiving means and operator information directly inputted by an operator;

a control means for extracting and outputting useful information from the first, second and third store means in response to the first scheduler;

an output means for outputting the information stored in the first, second and third store means;

a second receiving means for receiving character-based information from an external provider;

a fourth store means for storing the character-based information received from the second receiving means, the control information from the first receiving means and control information from an external operator; and a transmitting means for extracting the character-based and control information stored in the fourth store means and outputting the character-based and control information stored in the fourth store means to the first receiving means in response to the second scheduler.

8. A system in accordance with claim 7, wherein the output means comprises:

a picture information processing means for processing the picture information in the first, second and third store means;

a display processing means for determining a display type of the picture information received from the picture information processing means; and a picture output means for outputting the picture information received from the display processing means.

9. A system in accordance with claim 8, wherein the output means further comprises:

a voice information processing means for processing the picture information in the third store means; and a voice information processing means for processing the voice information received from the voice information processing means.

10. A system in accordance with claim 7, wherein, the operator information that is stored in the third store means, and directly inputted by the operator comprises moving and still picture information.

* * * * *